US006887841B2

(12) United States Patent
Mattia et al.

(10) Patent No.: US 6,887,841 B2
(45) Date of Patent: May 3, 2005

(54) APPARATUS AND METHOD FOR SOFTENING FABRIC IN A TUMBLE DRYER

(75) Inventors: Paul Mattia, Prior Lake, MN (US); Kim R. Smith, Woodbury, MN (US)

(73) Assignee: Ecolab Inc., St. Paul, MN (US)

( * ) Notice: Subject to any disclaimer, the term of this patent is extended or adjusted under 35 U.S.C. 154(b) by 359 days.

(21) Appl. No.: 10/138,344

(22) Filed: May 3, 2002

(65) Prior Publication Data

US 2003/0207785 A1 Nov. 6, 2003

(51) Int. Cl.[7] ..... C11D 17/00
(52) U.S. Cl. ..... 510/520; 34/63
(58) Field of Search ..... 510/520; 34/60, 34/63

(56) References Cited

U.S. PATENT DOCUMENTS

| | | | | |
|---|---|---|---|---|
| 3,442,692 A | | 5/1969 | Gaiser | 117/120 |
| 3,634,947 A | * | 1/1972 | Furgal | 34/60 |
| 3,676,199 A | | 7/1972 | Hewitt et al. | 117/109 |
| 3,686,025 A | | 8/1972 | Morton | 117/140 |
| 3,948,387 A | | 4/1976 | Haertle | 206/84 |
| 4,098,937 A | | 7/1978 | Mizuno et al. | 428/68 |
| 4,149,977 A | * | 4/1979 | Morganson et al. | 510/519 |
| 4,567,675 A | | 2/1986 | Rennie | 34/60 |
| 4,570,888 A | | 2/1986 | Evans | 248/205.1 |
| 4,891,890 A | | 1/1990 | Church | 34/12 |
| 5,658,651 A | | 8/1997 | Smith et al. | 442/59 |
| 5,787,606 A | | 8/1998 | Bokholdt | 34/527 |
| 5,869,410 A | | 2/1999 | Smith et al. | 442/333 |
| 5,966,831 A | | 10/1999 | Anderson | 34/60 |
| 6,238,736 B1 | | 5/2001 | Smith et al. | 427/242 |
| 6,254,932 B1 | | 7/2001 | Smith et al. | 427/242 |
| 6,305,046 B1 | | 10/2001 | Kingry et al. | 15/231 |

FOREIGN PATENT DOCUMENTS

| | | | |
|---|---|---|---|
| GB | 1383749 | | 2/1975 |
| GB | 1399728 | * | 7/1975 |
| GB | 2066309 A | * | 7/1981 |

* cited by examiner

*Primary Examiner*—John R. Hardee
(74) *Attorney, Agent, or Firm*—Vidas, Arrett & Steinkraus

(57) ABSTRACT

An apparatus for treating fabrics in a tumble dryer including a holder having at least one securement device for retaining a dryer sheet. The holder is inherently form-retaining and of such shape as to be readily tumbled with laundry in a tumble dryer, or it can be mounted to the inside surface of said tumble dryer.

25 Claims, 2 Drawing Sheets

APPARATUS AND METHOD FOR SOFTENING FABRIC IN A TUMBLE DRYER

FIELD OF THE INVENTION

The present invention relates to an apparatus for treating fabrics in a tumble-dryer and to methods of using the same.

BACKGROUND OF THE INVENTION

It is common to treat various types of fabrics during the laundering process with fabric-conditioning or treating agents to render the fabrics soft to the touch, to reduce tangling, knotting or wrinkling, to render them free of static electricity, to improve bacteria-resistance, to deodorize, and so forth, or to otherwise treat or condition them.

Since the advent of conditioning agents, consumers have come to expect fabrics emerging from the home laundering process to possess a certain level of softness, be relatively free of static, perfume, and so forth. An aqueous solution or dispersion of a fabric conditioning agent may be introduced during the washing or rinsing cycle of an automatic washing machine. Addition of the conditioner during the rinsing cycle is typically more effective in imparting the desired properties to the fabrics than addition during the washing cycle. The fabric conditioning agents are often of a cationic nature and are thus chemically incompatible with soaps and detergents which are typically anionic in nature. The addition of the conditioning agent during the final rinsing stage, however, requires manual addition of the conditioning agent by the consumer, a task which is often inconvenient, and as a consequence, is often forgotten. Furthermore, residual soaps and detergents are often present on the fabrics as a result of prior laundering which may also interfere with the use of these cationic conditioning agents even during the rinsing cycle.

Also, when applying an agent in a liquid dispersion or solution, there is typically about 16–20 times more solvent than agent which increases shipping and handling costs.

Attempts have therefore been made to deliver a benefit comparable to that obtained by the use of rinse conditioners, by adding fabric conditioner after the completion of the washing machine cycle, while the fabrics are drying in a tumble-dryer.

Flexible substrates coated or impregnated with a fabric softener and/or anti-static agent and designed for use in tumble dryers are commercially available and have become quite popular. Conditioning articles of the impregnated sheet type are described in U.S. Pat. No. 3,442,692.

There are, however, problems with the use of the impregnated sheet type of conditioners as well. For example, when conditioning articles of this type come into contact with a fabric in the tumble-dryer, conditioning agent is deposited locally, on the area of actual contact only. The deposition of conditioner may thus be non-uniform. If the fabric has an upstanding pile, such as with terrycloth towels or robes, for example, deposition may occur almost exclusively on the pile.

This problem is further compounded because these sheet type articles can become easily rolled, tangled and lodged in the fabrics being treated resulting in excessive dispensing of conditioning agent in one location, with a relatively small distribution of conditioning agent to the rest of the laundry load. The areas in contact with the fabric may thus become overloaded with conditioner while other areas of the load will not be conditioned at all. Overloading of conditioner in particular areas of fabric may lead to spotting and staining, although with current dryer sheets, such an occurrence is not as likely. The entanglement of the dryer sheet may also make the sheet difficult to locate and remove from the laundry.

SUMMARY OF THE INVENTION

The present invention relates to an improved apparatus for treating fabrics in a tumble dryer which provides a means for retaining a flexible sheet type of conditioning article in such a way as maximize the surface area available for contact with fabric, that is convenient to use, that does not become easily entangled in fabric, and that is easy to find and remove from a load of laundry.

The apparatus includes a holder having at least one securement device for retention of a dryer sheet which is inherently form-retaining and of such shape as to be readily tumbled with laundry in a tumble dryer. The apparatus may be optionally mounted on the inside surface of a tumble dryer.

In some embodiments, the holder includes a plurality of securement devices.

The present invention further relates to a package including a plurality of the apparatus of the present invention Dryer sheets may also be included as well as instructions for the end user.

The present invention also relates to a method of using the apparatus of the present invention for treating fabrics or laundry in a tumble dryer. The method includes tumbling the laundry with the apparatus of the present invention including a dryer sheet. The apparatus may either be tumbled with the laundry, or may be fixedly attached to the inside surface of the tumble dryer such that when the laundry is being tumbled, it comes into contact with the dryer sheet retained by the dryer sheet. The laundry may first be washed with detergent, soap and/or bleach, rinsed, and then rendered damp by centrifugal spinning. The laundry is typically tumbled in a damp or heated state, although dryers are also used in an air fluff mode in which laundry may be tumbled in a dry, cool state as well.

The present invention provides a apparatus to help maximize the surface area of a dryer sheet which is available for contact with the laundry.

DETAILED DESCRIPTIONS OF THE PREFERRED EMBODIMENTS

Figures 1, 2, 3:
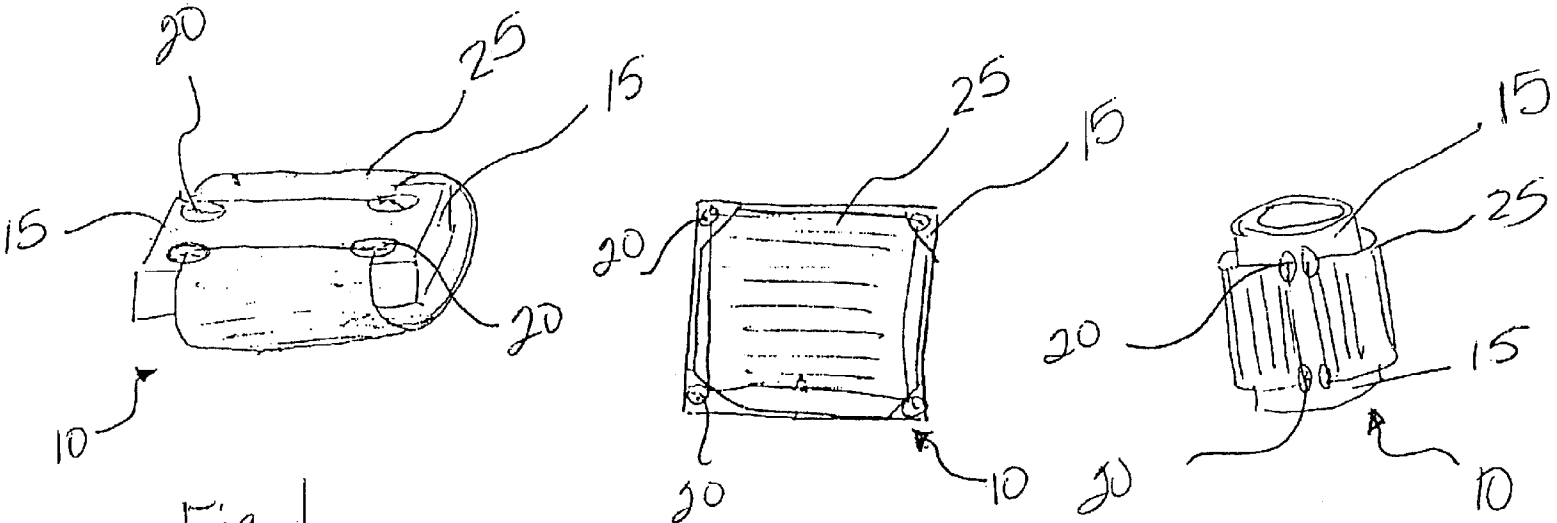
FIG. 1 shows a perspective view of one embodiment of the apparatus of the present invention.
FIG. 2 is a side view of an alternative embodiment of the apparatus of the present invention.
FIG. 3 is a side view of an alternative embodiment of the apparatus of the present invention.

While this invention may be embodied in many different forms, there are described in detail herein specific embodiments of the invention. This description is an exemplification of the principles of the invention and is not intended to limit the invention to the particular embodiments illustrated. Variations and modifications will become readily apparent to those of skill in the art and are intended to be encompassed within the scope of this invention.

The apparatus of the present invention includes a holder having at least one securement device for retention of a dryer sheet in a form so as to facilitate the maximization of the amount of surface area of the dryer sheet which is available for treating or conditioning fabrics during a laundering process.

As used herein, the term "dryer sheet" shall be used to refer to any flexible or inflexible sheet substrate which has been treated with agents for use in the treatment or conditioning of fabrics during the laundering process. Such substrates are known to those of skill in the art and include, for example, felts, woven and non-woven fabrics, paper toweling or scrims, swatches of various types of cloth, absorbent sponge, materials made through various forming processes including melted materials which are laid down on forms, and so forth. Substrates may also be made by any of a known number of methods including, but not limited to spunbonding, meltblowing, resin bonding, air-through bonding, hydroentangling, and so forth. Such substrates are known to those of ordinary skill in the art. The substrates may further be laminated, calendered, multi-ply, and so forth.

Examples of materials suitable for use herein include, but are not limited to, natural cellulosics and cottons, synthetic materials including polyolefins such as spunbonded polyolefins including polyethylenes and polypropylenes, polyesters, polyamides, synthetic cellulosics such as RAYON®, copolymers thereof, and mixtures thereof.

Examples of methods of manufacture of various substrates, and materials suitable for use herein, are described, for example, in U.S. Pat. No. 6,305,046 incorporated by reference herein in its entirety.

The terms "treating" or "conditioning" agents as used herein refer to those agents capable of imparting a benefit such as softness, anti-static properties, deodorization, crease-resistance, ironability, mildew resistance, antimicrobial properties, and so forth. This list is intended for illustrative purposes only and is not intended as an exhaustive list. Such treating agents are known to those of skill in the art. Some suitable agents are described in U.S. Pat. No. 3,686,025, the entire content of which is incorporated by reference herein in its entirety.

Incorporation and/or impregnation of the conditioning or treating agents into the dryer sheet substrate is well known in the art, but can be effected, for example, by application of a dispersion, solution, suspension, or so forth of the agent to the dryer sheet substrate such as by immersion, spraying, or any other coating technique known in the art and are described, for example, in U.S. Pat. No. 3,442,692, the content of which is incorporated by reference herein in its entirety. The substrate may then be wrung or pressed to remove excess fluid, and then dried leaving it substantially uniformly treated with the agent(s).

Other dryer sheets useful herein are disclosed U.S. Pat. No. 3,686,025, the content of which is incorporated by reference herein in its entirety.

Turning now to the figures, FIG. 1 illustrates one embodiment of the present invention in which the apparatus, shown generally at 10, includes a holder 15 in the form of a rectangular or square block. The holder 15 includes a plurality of securement devices 20 for securing a dryer sheet 25 to the holder 15.

Securement of the dryer sheet may be accomplished using any of means known to those of skill in the art including, for example, but not limited to, entrapment or insertion in a slot or other such device, tabs, and so forth. One embodiment of a useful securement structure is described in U.S. Pat. No. 6,305,046 incorporated by reference herein. In this embodiment, the holder is formed of flexible material into which a securement device is formed which includes a base triangle defined along two sides by slits which extend through the flexible material which forms the securement structures. In this embodiment, as described in U.S. Pat. No. 6,305,046, the attachment structures also preferably include a plurality of pie-shaped sections having apexes which meet at a common point. The pie-shaped sections are also defined along two sides by slits which extend through the flexible material of which forms the holder. The slits through the flexible material allow the pie shaped sections and the triangle to deflect under pressure so that a portion of the sheet may be pushed through the top surface of the holder through the securement structures in the holder, and in this embodiment, into a cavity.

While the above described securement structures may form a temporary securement of the dryer sheet onto the holder, the securement structures employed may also be permanent depending on the preference of the consumer and the holder employed. Some holders may be themselves disposable, and thus a permanent securement device may be employed. Other holders may themselves be reusable or non-disposable, employed in combination with a disposable dryer sheet, the holder then requiring a more temporary type of securement device from which the sheet may be easily removed by the end user. The holders may be designed and formed such that they are reusable over a certain number of uses, or, they may be more indefinitely reusable.

Thus, in an embodiment in which a non-disposable holding device is employed, and disposable dryer sheet, the securement device may be permanent and may include any known to those of skill in the art including, but not limited to, adhesives, staples, tacks, stitches, frames wherein the sheet is secured between two sides of the frame permanently, and so forth. Of course, other combinations and modifications of the above described embodiments will become readily apparent to those of ordinary skill in the art.

The holder 15 is configured so as to maximize the amount of surface area of the dryer sheet which is available for treating fabrics in a laundry dryer. Optionally, the holder may be secured to the inside surface of a dryer using, for example, but not limited to, clamps, bolts, rivets, and so forth. Adhesives may also be employed, as well as double sided tapes. Adhesives may be applied to the holder during the manufacturing process, along with a release liner which is easily removed. The adhesive employed, however, must have an adequate amount of heat resistance to withstand dryer temperatures.

FIG. 2 shows generally at 10 an alternative embodiment of the apparatus of the present invention in which the holder 15 is in the form of a frame. In this embodiment, a dryer sheet 25 may be held securely between two sides of the frame.

Alternatively, a securement device 20, may be added to the frame 15 for holding the dryer sheet 25. In this embodiment, both sides of the dryer sheet are available for treating fabrics in a dryer further maximizing the surface area available for the treatment of fabrics in a laundry dryer. Alternatively, the holder 15 may be secured to the inside surface of a laundry dryer.

FIG. 3 illustrates generally at 10 an embodiment of the apparatus of the present invention in which the holder 15 is in the form of a cylinder which further includes securement devices 20 for retaining a dryer sheet 25 about the cylinder. The cylinder 15 may be tumbled with the fabric or secured to the inside surface of a laundry dryer. Optionally, the cylinder may be in the form of a ball, for example.

Figure 4:
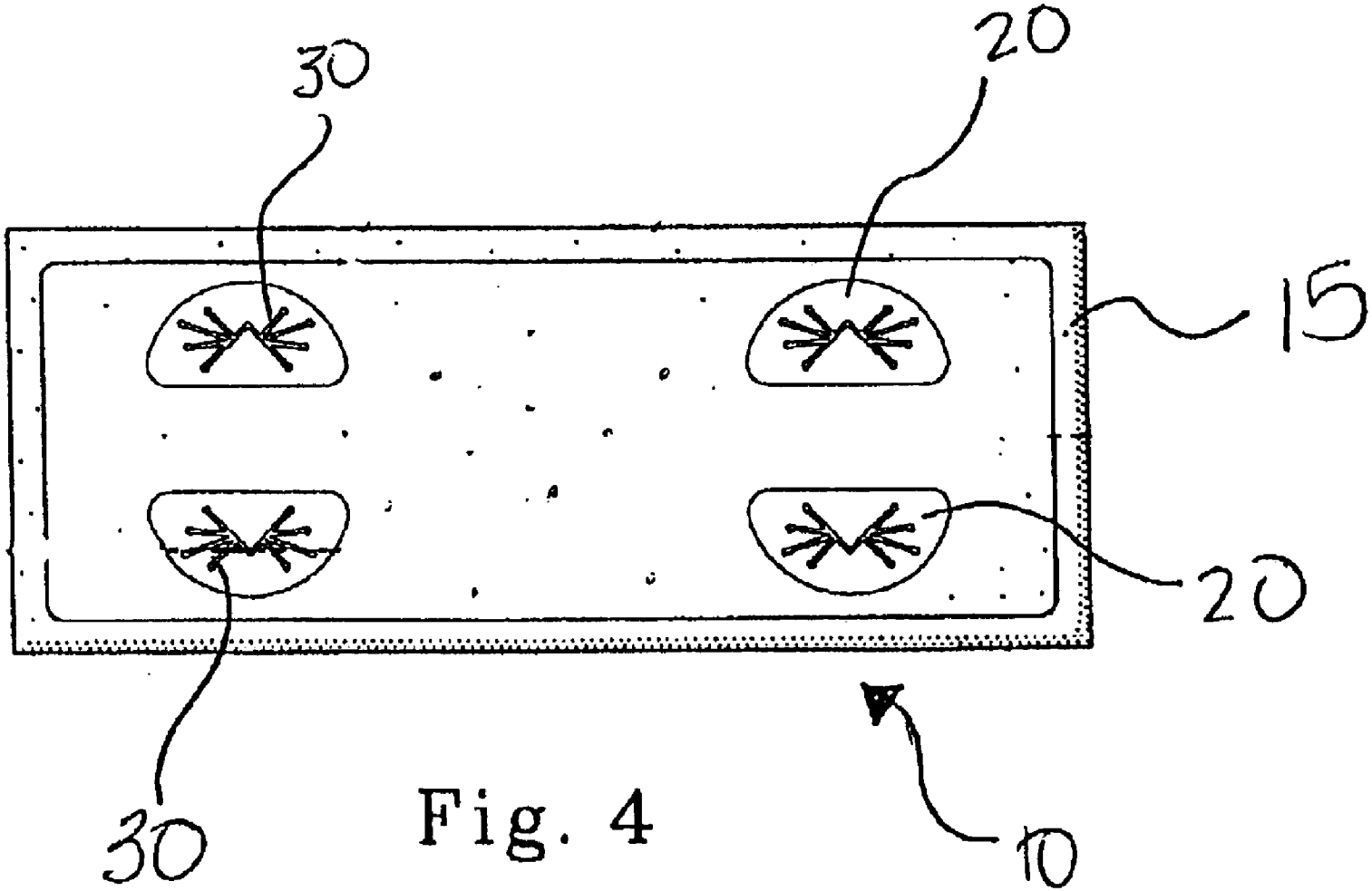
FIG. 4 is a three-dimensional view of an alternative embodiment of the apparatus of the present invention.

FIG. 4 illustrates generally at 10 an alternative embodiment of the apparatus of the present invention including a rectangular shaped holder 15 and a plurality of securement devices 20, one located at each corner of holder 15. Securement devices 20 are formed of a plurality of slits 30 which extend through the upper layer of the rectangular shaped holder 15 and into a cavity formed under the layer. A dryer sheet (not shown) may be pushed through the slits 30 by finger pressure where the dryer sheet is securely held. A more detailed description of the securement device of the type employed in this embodiment may be found in U.S. Pat. No. 6,305,046 which has been incorporated by reference herein.

Optionally, the apparatus could be in the form of a square, or other geometric shape.

The holder may be formed of any of a variety of materials including, but not limited to, polymeric materials, for example. Useful polymeric materials include, but are not limited to, polyolefins such as polyethylenes and polypropylenes, polyamides, polyvinylchlorides, polystyrenes, polyesters, polyurethanes, acrylonitriles, and so forth, as well as copolymers thereof and mixtures thereof. As used herein, the term "copolymer" is used to encompass any polymer formed of two or more monomers.

The materials may be employed to form flexible, as well as rigid substrates, and may be employed in both foamed and non-foamed versions using methods known in the art.

Methods of forming the holder including, but are not limited to injection molding, extrusion, blow molding, and so forth.

The apparatus of the present invention, in combination with a dryer sheet carrying the treating or conditioning agent(s), may be advantageously placed together with the fabrics that one desires to condition, in any laundry dryer.

Typically, the apparatus and dryer sheet, will be placed in a dryer, together with washed but still wet fabrics such as bedding, any type of clothing (including both under and outer garments), towels, and any other types of fabrics that may be laundered. Fabrics which are treated according to the present invention include, but are not limited to, wools, cottons, silks, leathers, and so forth, and synthetic fabrics such as polyesters, nylons, rayons, and so forth. A typical laundering process may involve a wash cycle in which the laundry is washed with detergents or soaps, a rinse cycle to remove a substantial amount of the detergents or soaps, and a centrifugal spin cycle in which the laundry is rendered damp, although still wet. However, dryer sheets may also be placed in a dryer during an air fluff cycle in which an already dry garment may be treated, such as to render it softer. During such an air fluff cycle, little or no heat is applied.

The holders of the present invention may be supplied in individual packages, or a plurality of holders may be supplied in one package. Individually supplied holders may be more desirable, for example, in an embodiment in which the holder is reusable or non-disposable. In the case of disposable holders, a dryer sheet may be either added during the manufacturing process, or dryer sheets may be post added by the consumer or end user.

Furthermore, instructions for use of the holder may be optionally included in each package in the form of a label, pamphlet, or insert, for example.

The above disclosure is intended for illustrative purposes only and is not exhaustive. The embodiments described therein will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An apparatus for treating fabrics in a tumble dryer having an inside surface and an outside surface comprising a holder for retention of a dryer sheet said holder comprising at least one non-adhesive securement device for retaining said dryer sheet and said holder being inherently form-retaining and of such shape as to be readily tumbled with laundry in said tumble dryer or mounted to the inside surface of said tumble dryer.

2. The apparatus of claim 1 further comprising a dryer sheet mounted thereon.

3. The apparatus of claim 2 wherein said dryer sheet comprises a cationic fabric softener.

4. The apparatus of claim 2 wherein said dryer sheet further comprises at least one compound selected from the group consisting of bleaches, bleach activators, sanitizers, fragrances, mildewicides, antimicrobial agents, anti-static agents, dyes, optical brighteners, release agents, soil release agents, color retention agents, and mixtures thereof.

5. The apparatus of claim 2 wherein said dryer sheet is a woven fabric, a nonwoven fabric, a felt or a sponge.

6. A method of conditioning laundry in a tumble dryer comprising tumbling said laundry with the apparatus of claim 2.

7. The apparatus of claim 1 wherein said holder is configured so as to maximize the surface area of said dryer sheet.

8. The apparatus of claim 1 wherein said holder is in the form of a block, cylinder, ball or frame.

9. The apparatus of claim 8 wherein said holder is in the form of a block, cylinder or ball and a dryer sheet is wrapped around said block, cylinder or ball.

10. The apparatus of claim 8 wherein said holder is in the form of a frame having a first side and a second side and the edges of said dryer sheet are retained between said first side and said second side.

11. The apparatus of claim 8 wherein said holder is in the form or a block, cylinder, ball or frame wherein potions of said dryer sheet may be inserted to attach said dryer sheet to said holder.

12. The apparatus of claim 1 comprising a plurality of securement devices.

13. The apparatus of claim 1 wherein said dryer sheet is entrapped by or inserted into said at least one non-adhesive securement device.

14. A package comprising a plurality of the apparatus of claim 1.

15. An apparatus for treating fabrics in a tumble dryer, having an inside surface and an outside surface comprising a holder for retention of a dryer sheet said holder comprising a plurality of securement devices for retaining said dryer sheet and said holder being inherently form-retaining and of such shape as to be readily tumbled with laundry in said tumble dryer or mounted to the inside surface of said tumble dryer, wherein each of said plurality of securement devices comprises a plurality of slits which extend through the surface of said holder.

16. A package comprising a plurality of apparatuses for treating fabrics in a tumble dryer of said apparatuses comprising a dryer sheet and a holder for retention of said dryer sheet, said holder comprising at least one securement device for retaining said dryer sheet and said holder being inherently form-retaining and of such shape as to be readily tumbled with laundry in said tumble dryer.

17. The package of claim 16 wherein each of said apparatuses comprises a holder which is configured to maximize the surface area of said dryer sheet.

18. A method of treating laundry in a tumble dryer having an inside surface and an outside surface comprising tumbling said laundry with a apparatus comprising a dryer sheet and a holder for retention of said dryer sheet, said holder comprising at least one non-adhesive securement device for retaining said dryer sheet and said holder being inherently form-retaining and of such shape as to be readily tumbled with laundry in said tumble dryer or fixedly attached to the inside surface of said tumble dryer.

19. The method of claim 18 wherein said laundry is in a damp or heated state.

20. The method of claim 18 wherein said holder is configured so as to maximize the surface area of said dryer sheet.

21. The method of claim 18 wherein said laundry is first washed with a detergent, soap, bleach or mixture thereof.

22. The method of claim 21 wherein said laundry is further rinsed substantially free of said detergent or soap.

23. The method of claim 22 wherein said laundry is further rendered damp by centrifugal spinning before being dried in said laundry dryer.

24. A disposable apparatus for treating fabrics in a tumble dryer having an inside surface and an outside surface comprising a holder for retention of a dryer sheet said holder comprising a frame having at least two sides and being inherently form-retaining, and of such shape as to be readily tumbled with laundry in said tumble dryer or mounted to the inside surface of said tumble dryer, the dryer sheet permanently retained between said at least two sides of said frame.

25. The disposable apparatus of claim 24, said dryer sheet permanently retained between said at least two sides with a securement means selected from the group consisting of adhesives, staples, tacks or stitches.

* * * * *